US007993112B2

(12) United States Patent
Rockwell

(10) Patent No.: US 7,993,112 B2
(45) Date of Patent: Aug. 9, 2011

(54) COMPRESSOR SOUND SUPPRESSION

(75) Inventor: David M. Rockwell, Cicero, NY (US)

(73) Assignee: Carrier Corporation, Farmington, CT (US)

( * ) Notice: Subject to any disclaimer, the term of this patent is extended or adjusted under 35 U.S.C. 154(b) by 231 days.

(21) Appl. No.: 12/144,839

(22) Filed: Jun. 24, 2008

(65) Prior Publication Data

US 2008/0260547 A1 Oct. 23, 2008

Related U.S. Application Data

(63) Continuation of application No. 10/956,509, filed on Sep. 30, 2004, now abandoned.

(51) Int. Cl.
*F04B 39/00* (2006.01)
*F04B 53/00* (2006.01)

(52) U.S. Cl. ..... 417/312; 417/410.4; 181/272

(58) Field of Classification Search ..... 417/410.4, 417/312; 181/272

See application file for complete search history.

(56) References Cited

U.S. PATENT DOCUMENTS

| | | | | |
|---|---|---|---|---|
| 1,555,192 | A * | 9/1925 | Dennedy | 417/539 |
| 2,990,906 | A * | 7/1961 | Audette | 181/256 |
| 4,415,059 | A * | 11/1983 | Hayashi | 181/250 |
| 4,475,867 | A | 10/1984 | Smith | |
| 4,957,517 | A | 9/1990 | Linnert | |
| 5,208,429 | A * | 5/1993 | Field | 181/229 |
| 5,605,447 | A | 2/1997 | Kim et al. | |
| 6,331,103 | B1 | 12/2001 | Teraoka | |
| 6,398,523 | B1 | 6/2002 | Hur et al. | |
| 6,488,480 | B1 * | 12/2002 | Zhong | 417/310 |
| 6,739,851 | B1 | 5/2004 | Holden | |
| 6,799,657 | B2 | 10/2004 | Daniels | |
| 6,802,388 | B2 * | 10/2004 | Wolf et al. | 181/265 |
| 6,976,833 | B2 | 12/2005 | Daniels et al. | |
| 7,121,814 | B2 | 10/2006 | Rockwell et al. | |
| 2004/0065504 | A1 | 4/2004 | Daniels | |

FOREIGN PATENT DOCUMENTS

| | | | |
|---|---|---|---|
| FR | 2393960 | A1 | 1/1979 |
| JP | 54054309 | A | 4/1979 |
| WO | 2005/012699 | A1 | 2/2005 |
| WO | 2006/039115 | A1 | 4/2006 |
| WO | 2006/043955 | A1 | 4/2006 |
| WO | 2006/043962 | A1 | 4/2006 |
| WO | 2006/110180 | A1 | 10/2006 |

OTHER PUBLICATIONS

European Search Report for EP Patent Application No. 05797856.1, dated Sep. 9, 2010.

* cited by examiner

*Primary Examiner* — Devon C Kramer
*Assistant Examiner* — Peter J Bertheaud
(74) *Attorney, Agent, or Firm* — Bachman & LaPointe, P.C.

(57) ABSTRACT

A compressor includes a housing and one or more working elements. A muffler is located downstream of the discharge plenum and a helmholtz resonator is located in the discharge plenum upstream of the muffler.

10 Claims, 4 Drawing Sheets

COMPRESSOR SOUND SUPPRESSION

CROSS-REFERENCE TO RELATED APPLICATION

This is a continuation application of Ser. No. 10/956,509, filed Sep. 30, 2004, and entitled COMPRESSOR SOUND SUPPRESSION, now abandoned, the disclosure of which is incorporated by reference herein in its entirety as if set forth at length.

BACKGROUND OF THE INVENTION

The invention relates to compressors. More particularly, the invention relates to sound and vibration suppression in screw-type compressors.

In positive displacement compressors, discrete volumes of gas are: trapped at a suction pressure; compressed; and discharged at a discharge pressure. The trapping and discharge each may produce pressure pulsations and related noise generation. Accordingly, a well developed field exists in compressor sound suppression.

One class of absorptive mufflers involves passing the refrigerant flow discharged from the compressor working elements through an annular space between inner and outer annular layers of sound absorptive material (e.g., fiber batting or foam). U.S. Pat. No. 6,799,657 B2 discloses a basic such muffler and then improved versions having integral helmholtz resonators formed within the inner layer. The disclosure of this '657 patent is incorporated by reference herein as if set forth at length.

Commonly owned and concurrently filed U.S. patent application Ser. No. 10/956,509, now abandoned, entitled Compressor Sound Suppression discloses a discharge plenum centerbody and methods for configuring such a centerbody. The disclosure of that application is incorporated by reference herein as if set forth at length.

SUMMARY OF THE INVENTION

One aspect of the invention involves a compressor including a housing and one or more working elements. A muffler is located downstream of the discharge plenum and a helmholtz resonator is located in the discharge plenum upstream of the muffler.

The helmholtz resonator may be formed in a centerbody between a bearing case and an inner element of the muffler. The helmholtz resonator may be added in a redesign or reengineering of an existing compressor configuration and/or a remanufacturing of an existing compressor previously lacking such a resonator. During the redesign/reengineering, parameters of the resonator may be optimized to provide a desired degree of suppression of a desired target type of vibration. The resonator may limit external sound radiated by the discharge housing and downstream piping due to resonating of discharge pulsation from the one or more working elements The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
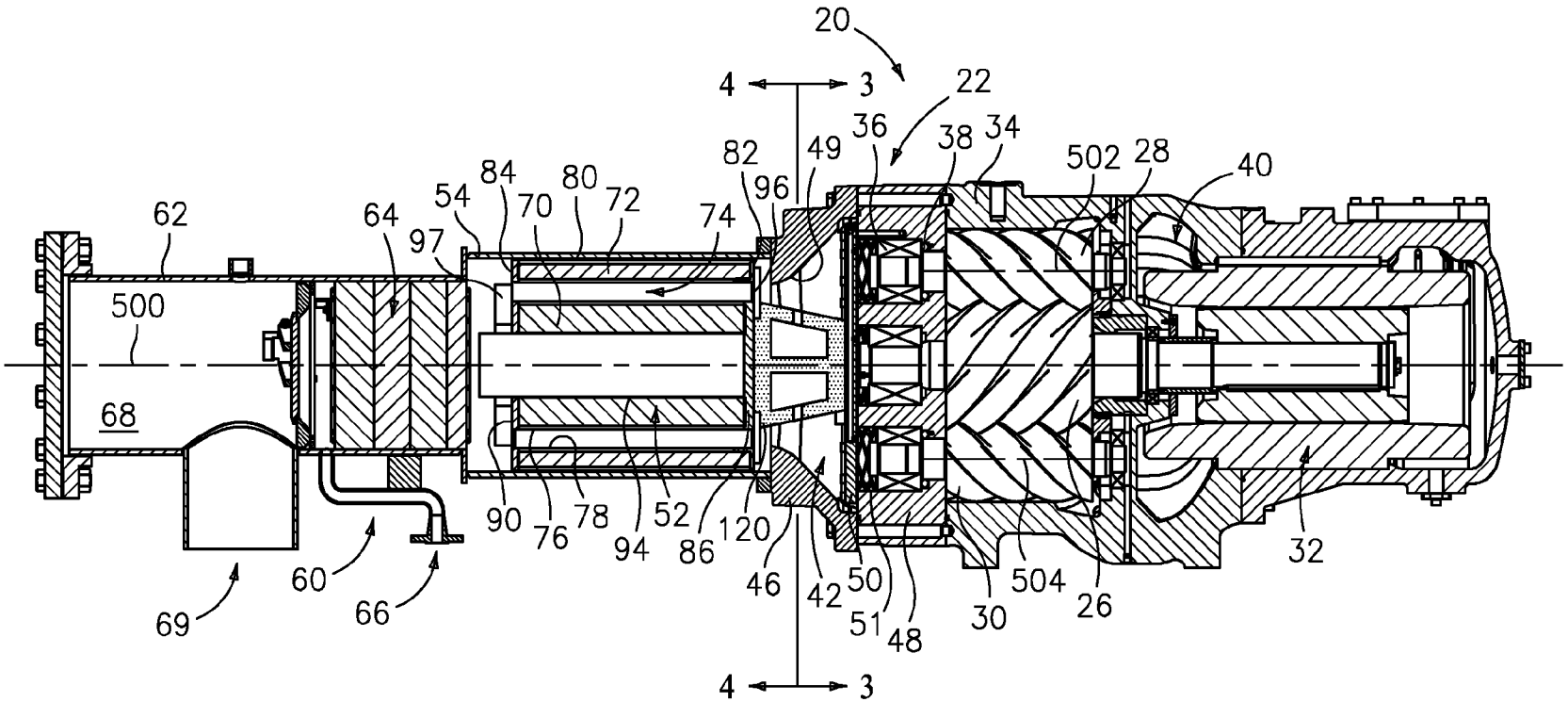
FIG. 1 is a longitudinal sectional view of a compressor.

FIG. 1 shows a compressor 20 having a housing or case assembly 22. The exemplary compressor is a three-rotor, screw-type, hermetic compressor having rotors 26, 28, and 30 with respective central longitudinal axes 500, 502, and 504. In the exemplary embodiment, the first rotor 26 is a male-lobed rotor driven by a coaxial electric motor 32 and, in turn, enmeshed with and driving the female-lobed rotors 28 and 30. In the exemplary embodiment, the male rotor axis 500 also forms a central longitudinal axis of the compressor 20 as a whole. The rotor working portions are located within a rotor case segment 34 of the case assembly 22 and may be supported by bearings 36 and sealed by seals 38 engaging rotor shafts at each end of the associated rotor working portion. When driven by the motor 32, the rotors pump and compress a working fluid (e.g., a refrigerant) along a flowpath from a suction plenum 40 to a discharge plenum 42. In the exemplary embodiment, the suction plenum 40 is located within an upstream end of the rotor case 34 and the discharge plenum is located generally within a discharge case 46 separated from the rotor case by a bearing case 48 and having a generally downstream-convergent interior surface 49. In the exemplary embodiment, a bearing cover/retainer plate 50 is mounted to a downstream end of the bearing case 48 to retain the bearing stacks. Downstream of the discharge case 46 is a muffler 52 in a muffler case 54. Downstream of the muffler 52 is an oil separator unit 60 having a case 62 containing a separator mesh 64. An oil return conduit 66 extends from the housing 62 to return oil stopped by the mesh 64 to a lubrication system (not shown). An outlet plenum 68 having an outlet port 69 is downstream of the mesh 64.

The exemplary muffler 52 includes annular inner and outer elements 70 and 72 separated by a generally annular space 74 (e.g., interrupted by support webs for retaining/positioning the inner element 70). These elements may be formed of sound absorption material (e.g., fiberglass batting encased in a nylon and steel mesh) In the exemplary embodiment, the inner element 70 is retained and separated from the space 74 by an inner foraminate sleeve 76 (e.g., nylon or wire mesh or perforated/expanded metal sheeting) and the outer element 72 is similarly separated and retained by an outer foraminate sleeve 78. In the exemplary embodiment, the outer element 72 is encased within an outer sleeve 80 (e.g., similarly formed to the sleeves 76 and 78) telescopically received within the housing 54. The sleeves 80 and 78 are joined at upstream and downstream ends by annular plates 82 and 84. In the exemplary embodiment, the upstream end of the sleeve 76 is closed by a circular plate 86 and the downstream end closed by an annular plate 90. In the exemplary embodiment, a non-foraminate central core 94 (e.g., steel pipe) extends through the inner element 70 and protrudes beyond a downstream end thereof.

In operation, compressed gas flow exits the compression pockets of the screw rotors 26, 28, 30 and flows into the discharge plenum 42. Upon exiting the compressor discharge plenum, the gas enters the muffler case 54 and flows down the annular space 74. Upon exiting the muffler the gas flow, which typically has entrained oil droplets, flows through the oil separating mesh 64. The mesh 64 captures any oil entrained in the gas and returns it to the oil management system by means of the conduit 66. The gas leaves the oil separating mesh and enters the plenum 68 and exits the outlet 69 toward the condenser (not shown).

As so far described, the compressor may be of an existing configuration although the principles of the invention may be applied to different configurations.

Figure 2:
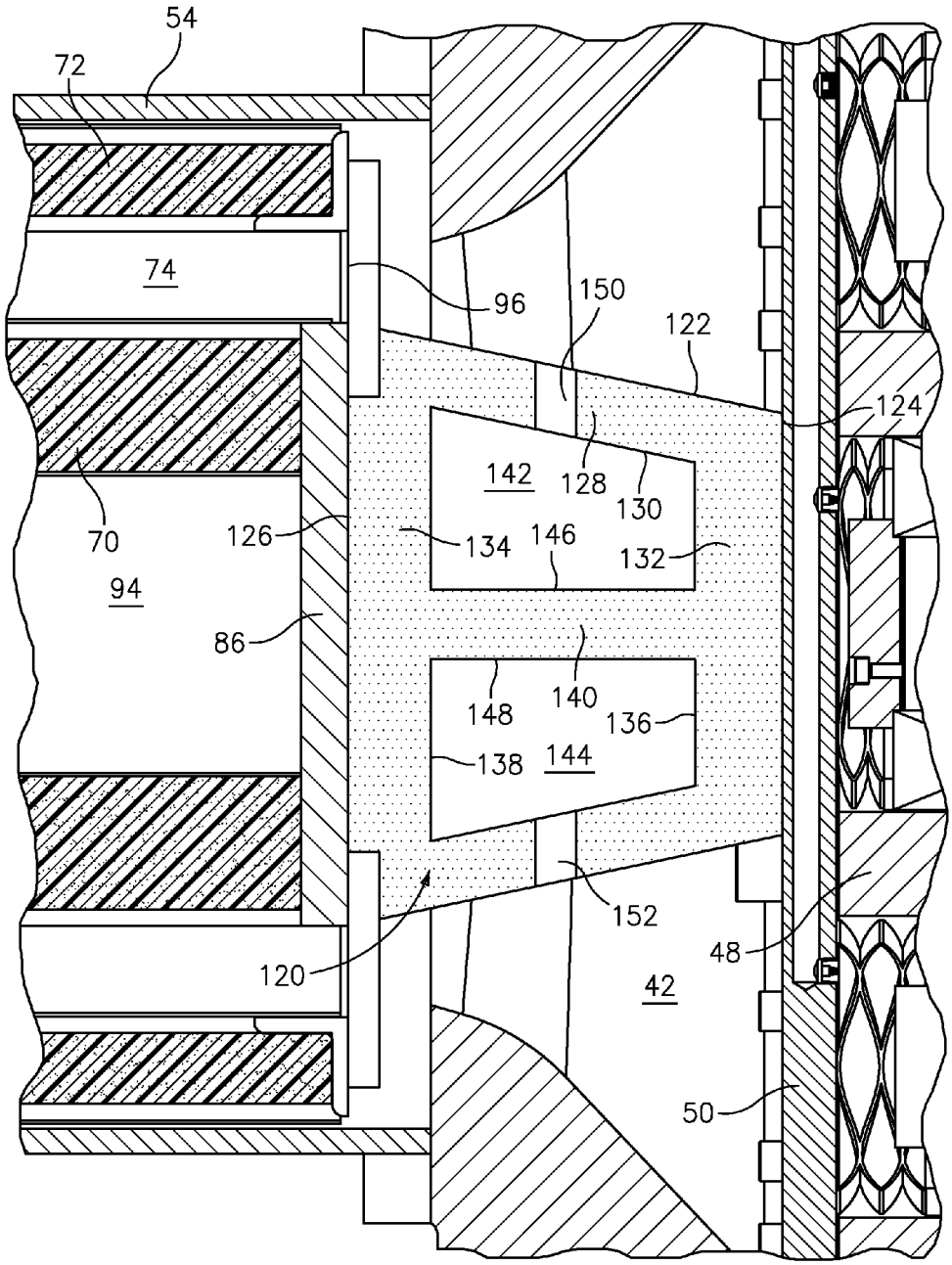
FIG. 2 is an enlarged view of a discharge plenum of the compressor of FIG. 1.

A centerbody 120 is positioned in the flowpath between the rotors and the muffler. FIG. 2 shows the centerbody 120 having a generally frustoconical outer surface 122 extending from a circular upstream end/face 124 to a circular downstream face 126. The exemplary centerbody 120 has an annular sidewall 128 having an inboard surface 130 and upstream and downstream end walls 132 and 134 having inboard surfaces 136 and 138. In the exemplary embodiment, the sidewall and end walls are spanned by a transverse wall 140 to create an exemplary two interior chambers 142 and 144. The wall 140 has respective opposed surfaces 146 and 148 facing the chambers 142 and 144. In the exemplary embodiment, a single outlet port or passageway 150 and 152 extends through the sidewall 128 from the associated chamber 142 and 144. The exemplary passageways 150 and 152 are of generally right circular cylindrical section characterized by a diameter, an associated cross-sectional area, and an associated length.

Figure 3:
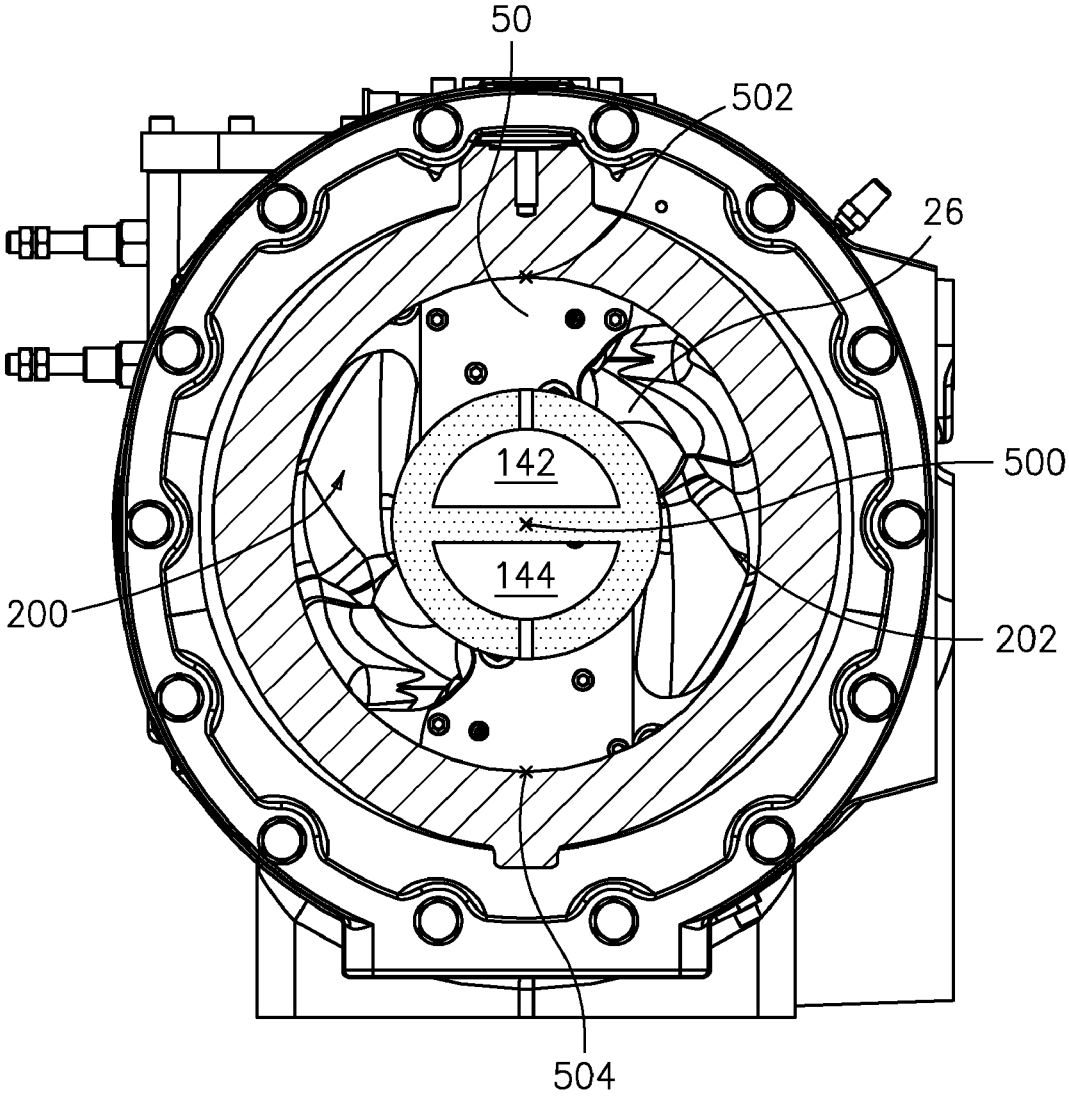
FIG. 3 is a sectional view of the compressor of FIG. 1 taken along line 3-3.
Figure 4:
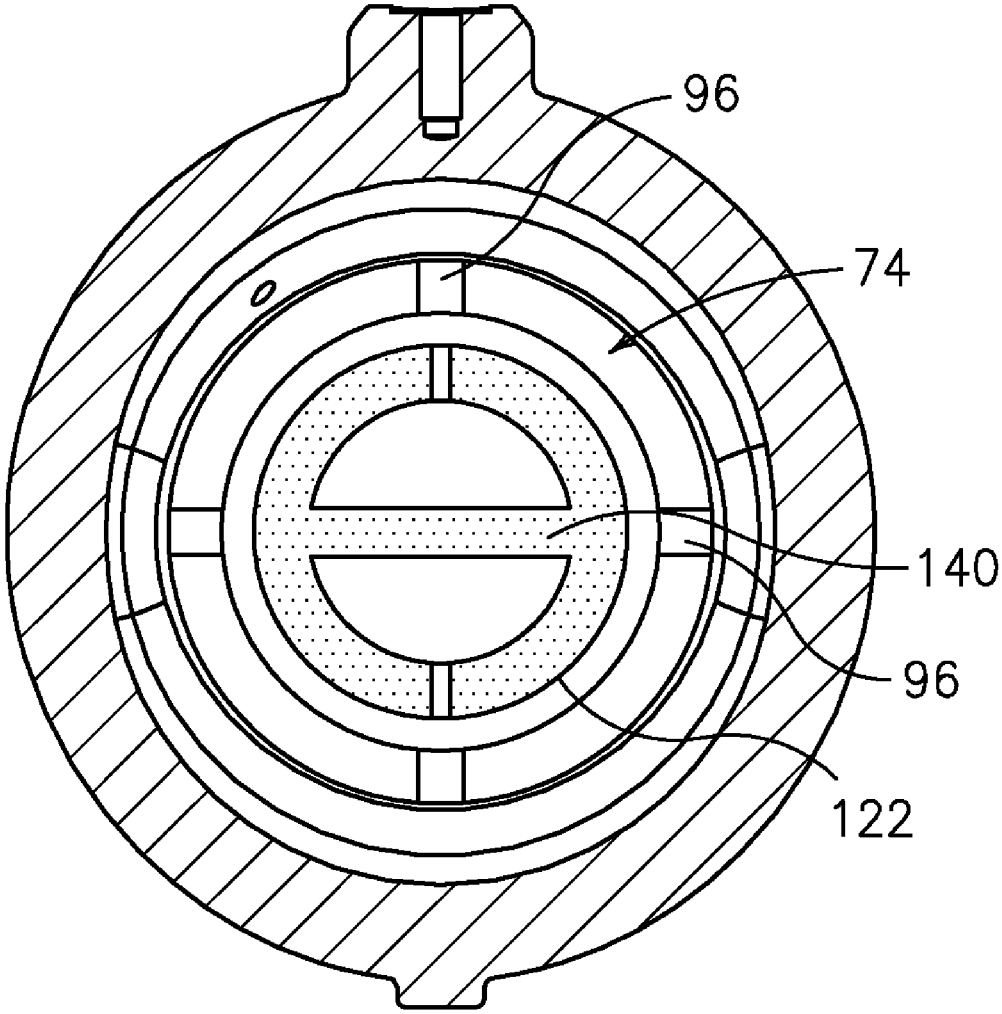
FIG. 4 is a sectional view of the compressor of FIG. 1 taken along line 4-4.

FIG. 3 shows discharge ports 200 and 202 open to the discharge plenum 42 for discharging the compressed refrigerant. In the exemplary embodiment, the centerbody ports 150 and 152 are (when viewed along and about the axis 500) respectively aligned with the positions of the axes 502 and 504. The discharge ports 200 and 202 are oriented to direct the gas flow exiting the rotors to the discharge plenum 42. The ports are located at the end of the compression pocket produced by the meshing between the male and female rotors. In a two-rotor configuration, only one discharge port would be required. The ports direct the flow around cavities containing the discharge bearings 36 and seals 38. The cavities are enclosed by the bearing cover 50.

Various materials and techniques may be used to manufacture the centerbody. The centerbody may consist essentially of at least one of molded plastic (e.g., non-foam polypropylene or glass-filled nylon) or of polymeric foam or expanded bead material (e.g., molded in one or more pieces or cut from one or more pieces).

In the exemplary embodiment, the overall size and shape of the centerbody are chosen to provide a smooth transition from the discharge ports to the muffler. For example, a streamwise variation in centerbody exterior cross-section (e.g., a frustoconical taper) may be selected to limit a pressure drop across the discharge plenum between the rotors and the muffler. Accordingly, the upstream/front face 124 may be sized to correspond to the inboard contours of the ports 200 and 202 defined by the plate 50. This may be at a radius essentially equal to the root radius of the working portion of the rotor 26.

Similarly, the downstream/aft face 126 may be dimensioned correspondingly to the inner element of the muffler (e.g., having a similar outer radius). The openings in the centerbody leading to the cavities are advantageously oriented normal to the local compressor discharge flow. The cavity volume and the number of cavities may be selected to address one or more particular sound frequencies. For example the first cavity 142 and passage 150 could be tuned for one frequency. The second cavity 144 and passage 152 could be tuned for a different frequency. Also the cavities within the centerbody are not limited to two. One or multiple could be provided. Further, the cavities could be filled fully or partially with sound absorption material, depending on the frequency of sound to be controlled.

The volumes of the chambers 142 and 144 and the shape, cross-sectional areas, and lengths of the passageways 150 and 152 may be selected to provide advantageous sound suppression. The engineering and/or optimization of the resonator may be undertaken at a variety of levels from basic to detailed and may involve a variety of theoretical/simulation and/or practical/experimentation steps. Well-developed helmholtz resonator optimization techniques may be applied. For example, the parameters may be optimized to provide maximum suppression at a particular target operating speed. Alternatively, the parameters may be optimized to provide a desired level of suppression over a desired range of speed or series of discrete speeds. The parameters may be optimized to provide desired suppression at non-target operating speeds which otherwise experience particularly significant resonance-associated noise.

For example, a target frequency may be calculated as a function of a target rotational speed and the rotor geometry-numbers of lobes/pockets). A first approximation of port size and volume size may be calculated based upon that target frequency and a prototype built. With the prototype, sound intensity at the target frequency may be measured. At least one parameter of the at least one internal volume or the at least one port may be selected/varied and the intensity remeasured in an iterative process to achieve a desired level of said intensity.

The centerbody may be incorporated in the remanufacturing of a compressor or reengineering of a compressor configuration. In the reengineering or remanufacturing, various existing elements may be essentially preserved.

One or more embodiments of the present invention have been described. Nevertheless, it will be understood that various modifications may be made without departing from the spirit and scope of the invention. For example, in a reengineering or remanufacturing situation, details of the existing compressor may particularly influence or dictate details of the implementation. Accordingly, other embodiments are within the scope of the following claims.

What is claimed is:

1. A compressor comprising:

a housing;

a first rotor having a first rotational axis;

a second rotor having a second rotational axis and enmeshed with the first rotor;

a third rotor having a third rotational axis and enmeshed with the first rotor;

a discharge plenum;

a muffler downstream of the discharge plenum;

a centerbody within the discharge plenum and having:

an outer surface;

at least one internal volume;

and at least one port in the outer surface providing communication between the internal volume and an interior of the discharge plenum;

wherein the centerbody extends substantially the entire length of the discharge plenum between the rotors and the muffler.

2. The compressor of claim 1 wherein:

the centerbody is coaxial with the first rotor.

3. The compressor of claim 1 wherein:

the centerbody outer surface is essentially frustoconical.

4. The compressor of claim 1 wherein:

a downstream portion of the centerbody has a diameter at least 10% greater than an upstream portion of the centerbody.

5. The compressor of claim 1 wherein:

the centerbody outer surface is essentially divergent in a direction toward the muffler.

6. The compressor of claim 1 wherein the centerbody consists essentially of at least one of molded plastic, polymeric foam, and expanded bead material.

7. The compressor of claim 1 having:

first and second such internal volumes; and a first such port communicating with the first internal volume and a second such port communicating with the second internal volume.

8. The compressor of claim 7 wherein:

measured about the first axis, the first port is within 20° of the second axis; and measured about the first axis, the second port is within 20° of the third axis.

9. The compressor of claim 7 wherein:

measured about the first axis, the first port is essentially aligned with the second axis; and measured about the first axis, the second port is essentially aligned with the third axis.

10. The compressor of claim 7 wherein:

the first and second internal volumes and the first and second ports are effective to provide first and second helmholtz resonators.

* * * * *